US009326648B2

(12) United States Patent
Trampolski

(10) Patent No.: US 9,326,648 B2
(45) Date of Patent: May 3, 2016

(54) DISPENSING SYSTEM FOR CONSECUTIVELY DISPENSING PAPER SHEET MATERIAL FROM A STUB ROLL AND A PRIMARY ROLL

(71) Applicant: DISPENSING DYNAMICS INTERNATIONAL, City of Industry, CA (US)

(72) Inventor: Alex Trampolski, Richmond (CA)

(73) Assignee: Dispensing Dynamics International, City of Industry, CA (US)

( * ) Notice: Subject to any disclaimer, the term of this patent is extended or adjusted under 35 U.S.C. 154(b) by 244 days.

(21) Appl. No.: 13/916,765

(22) Filed: Jun. 13, 2013

(65) Prior Publication Data

US 2014/0367507 A1 Dec. 18, 2014

(51) Int. Cl.

| | |
|---|---|
| ***A47K 10/34*** | (2006.01) |
| ***A47K 10/36*** | (2006.01) |
| ***A47K 10/38*** | (2006.01) |
| *A47K 10/32* | (2006.01) |

(52) U.S. Cl.

CPC ..... *A47K 10/3687* (2013.01); *A47K 10/3836* (2013.01); *A47K 2010/324* (2013.01); *A47K 2010/3206* (2013.01)

(58) Field of Classification Search

CPC ..... A47K 10/3687; A47K 2010/3253; A47K 10/3836; A47K 2010/3206; A47K 2010/324

USPC ..... 242/560–560.3, 558–559.1, 559.4, 561

See application file for complete search history.

(56) References Cited

U.S. PATENT DOCUMENTS

| | | | | |
|---|---|---|---|---|
| 1,025,312 | A | 5/1912 | Rydquist | |
| 1,026,128 | A | 5/1912 | Rydquist | |
| 1,084,598 | A | 1/1914 | Antone | |
| 1,860,668 | A | 5/1932 | Gillet | |
| 2,169,399 | A | 8/1939 | Steiner | |
| 2,930,664 | A | 3/1960 | Liebisch | |
| 2,957,636 | A | 10/1960 | Lesavoy | |
| 3,107,957 | A | 10/1963 | Batlas et al. | |
| 3,140,060 | A | 7/1964 | Layton et al. | |
| 3,628,743 | A | 12/1971 | Bastian et al. | |
| 3,672,552 | A | 6/1972 | Krueger et al. | |
| 4,165,138 | A * | 8/1979 | Hedge et al. | 242/560 |
| 4,192,442 | A | 3/1980 | Bastian et al. | |
| 4,317,547 | A * | 3/1982 | Graham, Jr. | A47K 10/3687 242/560.1 |
| 4,358,169 | A | 11/1982 | Filipowicz et al. | |
| 4,699,304 | A | 10/1987 | Voss et al. | |
| 4,756,485 | A | 7/1988 | Bastian et al. | |
| 4,807,824 | A | 2/1989 | Gains et al. | |
| 4,844,361 | A * | 7/1989 | Granger | A47K 10/3687 225/93 |

(Continued)

FOREIGN PATENT DOCUMENTS

| | | |
|---|---|---|
| GB | 794825 | 5/1958 |
| GB | 1114891 | 5/1968 |

*Primary Examiner* — Sang Kim
*Assistant Examiner* — Nathaniel Adams
(74) *Attorney, Agent, or Firm* — Thomas R. Lampe

(57) ABSTRACT

A system for consecutively dispensing paper sheet material from a stub roll and a primary roll which utilizes a pivoted transfer door to locate a lead end portion of the primary roll in dispensing position responsive to disengagement between the transfer door and a pivoted lever supporting the stub roll.

17 Claims, 4 Drawing Sheets

(56) References Cited

U.S. PATENT DOCUMENTS

| | | | | |
|---|---|---|---|---|
| 4,846,412 | A | 7/1989 | Morand | |
| 5,244,161 | A | 9/1993 | Wirtz-Odenthal | |
| 5,294,192 | A | 3/1994 | Omdoll et al. | |
| 5,302,167 | A * | 4/1994 | Kley et al. | 493/400 |
| 5,400,982 | A * | 3/1995 | Collins | A47K 10/3687 242/560 |
| 5,979,822 | A | 11/1999 | Morand et al. | |
| 6,145,779 | A * | 11/2000 | Johnson et al. | 242/560.1 |
| 6,152,397 | A | 11/2000 | Purcell | |
| 7,270,292 | B2 | 9/2007 | Rasmussen | |
| 7,570,067 | B2 | 8/2009 | Denen et al. | |
| 8,282,033 | B2 | 10/2012 | Achton | |
| 2011/0253829 | A1 | 10/2011 | Goeking et al. | |

* cited by examiner

DISPENSING SYSTEM FOR CONSECUTIVELY DISPENSING PAPER SHEET MATERIAL FROM A STUB ROLL AND A PRIMARY ROLL

TECHNICAL FIELD

This invention relates to apparatus for dispensing sheet material, for example toilet tissue or toweling, from a roll of sheet material. More specifically, the invention relates to an apparatus and a method for consecutively dispensing paper sheet material from a stub roll of paper sheet material and a primary roll of paper sheet material.

BACKGROUND OF THE INVENTION

A great many systems have been devised over the years for dispensing toilet tissue and paper toweling from rolls thereof. Some systems incorporate mechanisms for automatically introducing the lead end of sheet material in roll form such as paper toweling or toilet tissue into a transport or feed mechanism, including a rotatable feed roller, responsive to depletion of another roll.

One such arrangement for doing so is disclosed in U.S. Pat. No. 5,979,822, issued Nov. 9, 1999, wherein a tucker member is attached to a sheet material engagement member and rotates upon depletion of a primary roll of sheet material to position the end of a reserve roll between the sheet material engagement member and a feed roller.

Other arrangements for effecting transfer to full or primary rolls from depleted or exhausted rolls are known in the prior art.

The following patent documents are believed to be representative of the present state of the prior art in this field: U.S. Pat. No. 5,979,822, issued Nov. 9, 1999, U.S. Pat. No. 1,025,312, issued May 7, 1912, U.S. Pat. No. 1,026,128, issued May 14, 1912, U.S. Pat. No. 1,084,598, issued Jan. 20, 1914, U.S. Pat. No. 1,860,668, issued May 31, 1932, U.S. Pat. No. 2,169,399, issued Aug. 15, 1939, U.S. Pat. No. 2,930,664, issued Mar. 29, 1960, U.S. Pat. No. 2,957,636, issued Oct. 25, 1960, U.S. Pat. No. 3,107,957, issued Oct. 22, 1963, U.S. Pat. No. 3,140,060, issued Jul. 7, 1964, U.S. Pat. No. 3,628,743, issued Dec. 21, 1971, U.S. Pat. No. 3,672,552, issued Jun. 27, 1972, U.S. Pat. No. 4,192,442, issued Mar. 11, 1980, U.S. Pat. No. 4,699,304, issued Oct. 13, 1987, U.S. Pat. No. 4,756,485, issued Jul. 12, 1988, U.S. Pat. No. 4,807,824, issued Feb. 28, 1989, U.S. Pat. No. 4,846,412, issued Jul. 11, 1989, U.S. Pat. No. 5,294,192, issued Mar. 15, 1994, U.S. Pat. No. 5,244,161, issued Sep. 14, 1993, U.S. Pat. No. 4,358,169, issued Nov. 9, 1982, U.S. Pat. No. 5,294,192, issued Mar. 15, 1994, U.S. Pat. No. 7,570,067, issued Aug. 4, 2009, U.S. Pat. No. 7,270,292, issued Sep. 18, 2007, U.S. Pat. No. 6,152,397, issued Nov. 28, 2000, U.S. Pat. No. 8,282,033, issued Oct. 9, 2012, U.S. Patent App. Pub. No. US 2011/0253829, published Oct. 20, 2011, UK Patent No. 794825, and UK Patent No. 1114891.

DISCLOSURE OF INVENTION

The present invention relates to a dispensing apparatus and dispensing method for consecutively dispensing paper sheet material from a stub roll of the paper sheet material and a primary roll of the paper sheet material. The invention is characterized by its relatively low cost, high reliability and ease of use.

The dispensing apparatus of the present invention includes a dispensing cabinet defining an interior.

A primary roll holder is within the dispensing cabinet interior for holding a primary roll of paper sheet material and allowing rotation thereof during dispensing of paper sheet material from the primary roll of paper sheet material.

A stub roll holder is within the dispensing cabinet interior spaced from the primary roll holder for holding a stub roll of paper sheet material and allowing rotation thereof during dispensing of paper sheet material from the stub roll of paper sheet material.

Dispensing mechanism is provided. The dispensing mechanism includes a rotatable drum having an outer surface supporting paper sheet material from the stub roll during dispensing of paper sheet material from the stub roll.

A lever having first and second lever ends is pivotally mounted within the cabinet interior, the stub roll holder attached to the first lever end.

A stub roll support is engaged by the outer periphery of the stub roll and provides support for the stub roll and the stub roll holder. The stub roll holder is biased in the direction of the stub roll support and moveable toward the stub roll support during dispensing of paper sheet material from the stub roll.

The apparatus also includes a pivotally mounted transfer door having a proximal portion and a distal portion located within the cabinet interior adjacent to the rotatable drum and biased to move the distal portion toward the rotatable drum.

The second lever end is engageable with the transfer door to prevent movement of the distal portion toward the rotatable drum, pivoting of the lever caused by exhaustion of the stub roll disengaging the second lever end from the transfer door and allowing pivoting of the transfer door and movement of the distal portion toward the rotatable drum to place a lead end portion of the primary roll into a position on the rotatable drum allowing dispensing of paper sheet material from the primary roll upon rotation of the rotatable drum.

Other features, advantages and objects of the present invention will become apparent with reference to the following description and accompanying drawings.

BEST MODE FOR CARRYING OUT THE INVENTION

Figure 1:
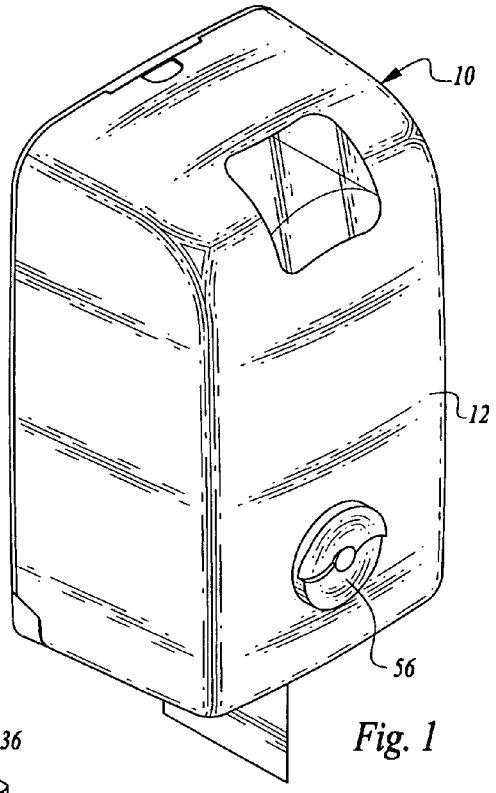
FIG. 1 is a perspective view of a dispensing cabinet of the dispensing apparatus of the present invention, a paper sheet material tail projecting downwardly from the cabinet.
Figure 2:
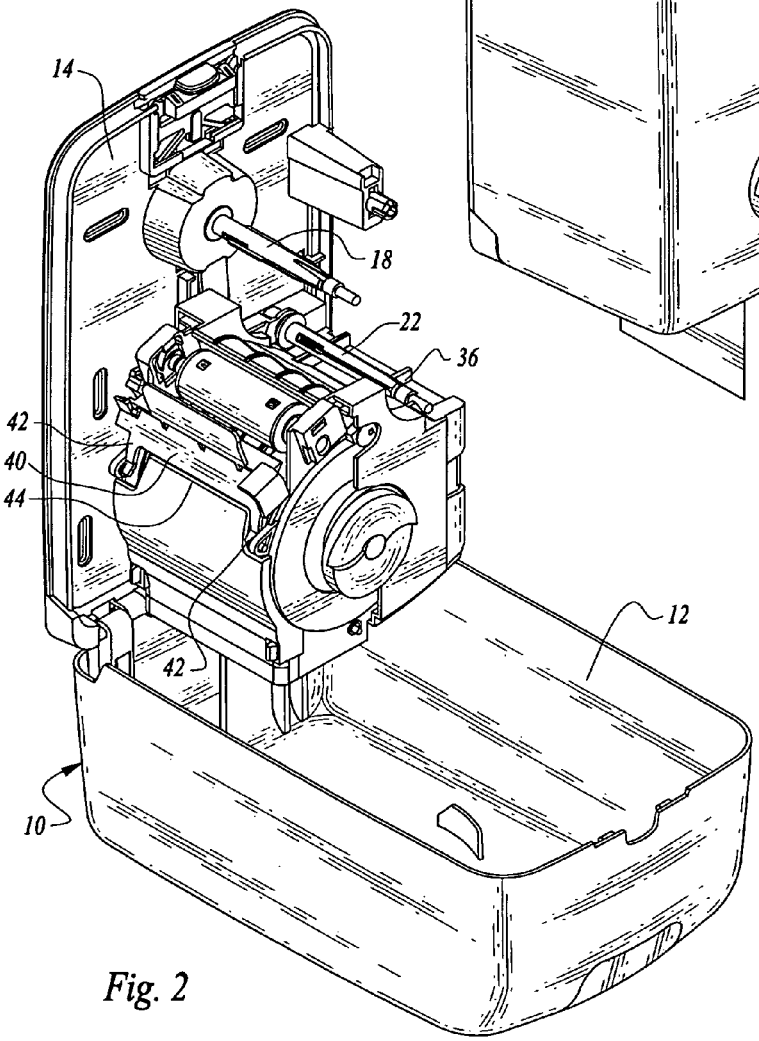
FIG. 2 is a perspective view showing the cover of the cabinet opened to disclose the structure located within the dispensing cabinet interior.

Referring now to the drawings, dispensing apparatus constructed in accordance with the teachings of the present invention is illustrated, the dispensing apparatus including a dispensing cabinet 10 having a cover 12 pivotally mounted on a base 14, suitably wall mounted. The dispensing apparatus is for consecutively dispensing paper sheet material from a stub roll of said paper sheet material and a primary roll of the paper sheet material.

In the disclosed arrangement the paper sheet material is toilet tissue formed into coreless rolls. The principles of the present invention also are applicable to paper toweling and both rolls with cores and coreless rolls.

Figure 3:
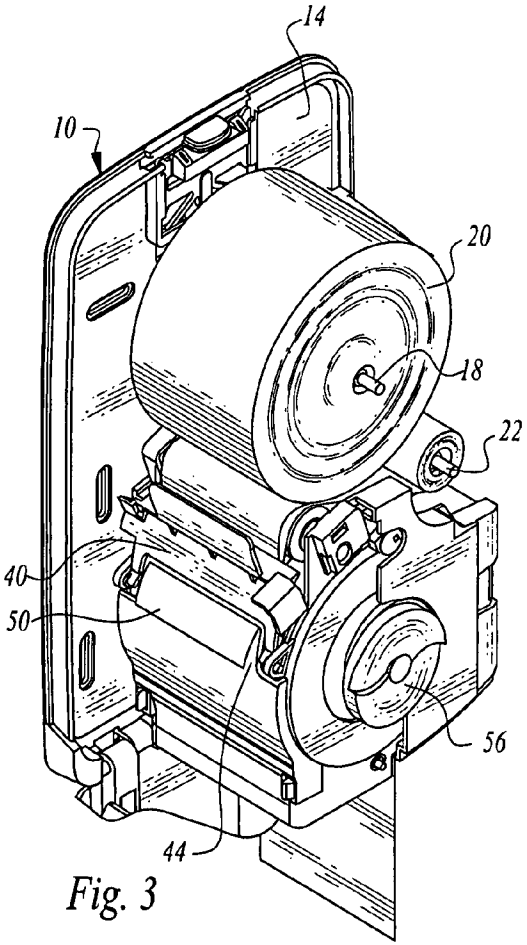
FIG. 3 is a perspective view of the dispensing apparatus with the cover removed and showing a coreless primary roll rotatably mounted on a spindle or primary roll holder and a coreless stub roll mounted on another spindle or stub roll holder, the tail of the stub roll projecting downwardly from the cabinet and the lead end portion of the primary roll located within an opening of a transfer door.

A primary roll holder in the form of a spindle 18 projects forwardly from the mounting base 14. Spindle 18 is for holding a primary roll of paper sheet material and allowing rotation thereof during dispensing of paper sheet material from the primary roll of paper sheet material. FIG. 3, for example, shows a full primary coreless roll 20 of toilet tissue.

The dispensing apparatus also includes a stub roll holder in the form of a spindle 22 for holding a stub roll of paper sheet material and allowing rotation thereof during dispensing of paper sheet material from the stub roll. FIG. 3, for example, shows a coreless stub roll 24 of toilet tissue disposed on spindle 22.

The dispensing apparatus also includes dispensing mechanism including a rotatable drum or toweling support roller 28 having an outer surface supporting paper sheet material from the stub roll 24 during dispensing of paper sheet material from the stub roll. Dispensing from the stub roll will be described in greater detail below.

Figure 5:
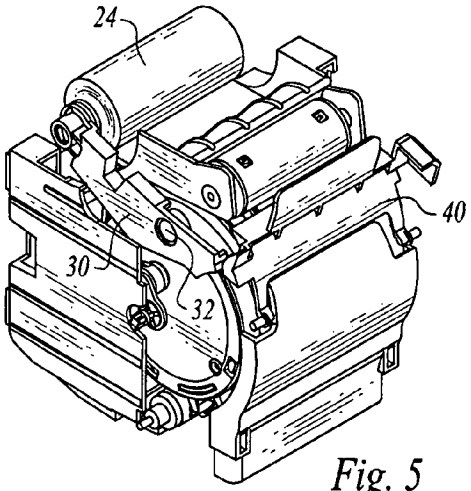
FIG. 5 is a perspective view of the dispensing mechanism and roll holder structure removed from the cabinet altogether and viewed from the left side rather than from the right side as presented in FIGS. 3 and 4, the primary roll and primary roll holder not being illustrated.
Figure 6:
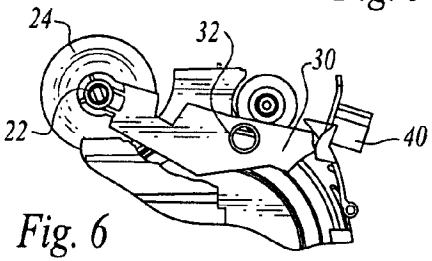
FIG. 6 is a sectional, side, elevational view illustrating the condition of a lever and the transfer door of the system when a stub roll is in place on the stub roll holder but not exhausted.
Figure 7:
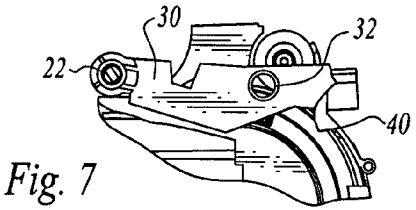
FIG. 7 is a view similar to FIG. 6 showing the structural elements shown in FIG. 6, but illustrating their condition when the stub roll is exhausted.

The dispensing apparatus also includes a lever 30 that is pivotally mounted within the cabinet interior about pivot 32. This may be seen for example in to FIGS. 5-7. Spindle 22 is attached to and projects outwardly from one end of the lever.

Figure 11:
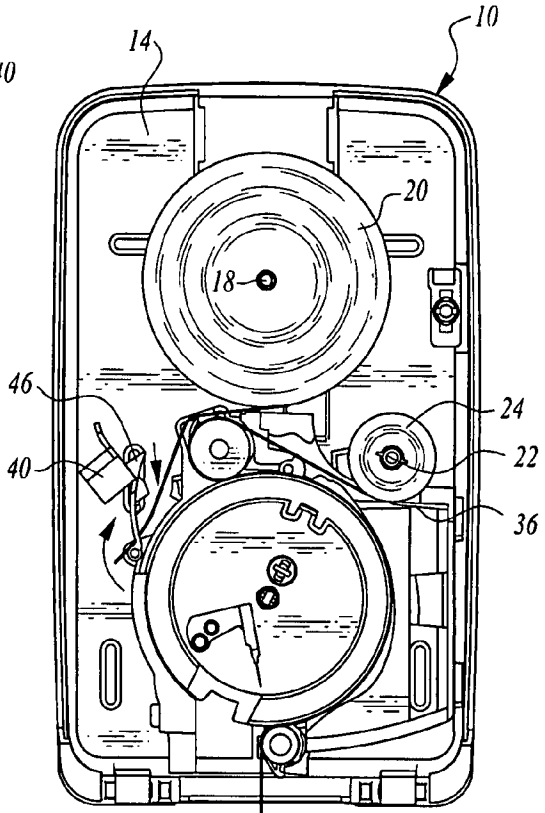
FIG. 11 is a view similar to FIG. 9, but illustrating a primary roll positioned in place in the dispensing cabinet with the lead end portion thereof positioned in a transfer door opening while the paper sheet material from the stub roll is still in position to be dispensed.
Figure 10:
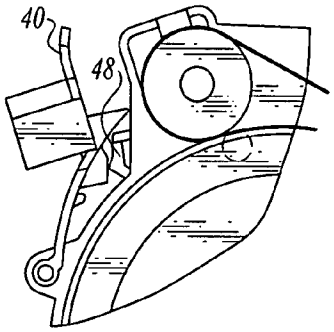
FIG. 10 is an enlarged, elevational view showing enlarged details of the arrangement of FIG. 9, more particularly details of a nip roller employed with a rotatable drum and positioning of the transfer door and lever before the stub roll has been exhausted.
Figure 12:
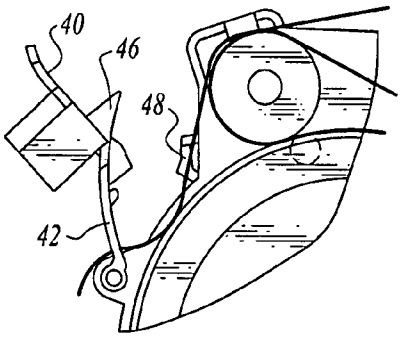
FIG. 12 is a view similar to FIG. 10, but showing more detail concerning positioning of the primary roll lead end portion into the transfer door opening.
Figure 9:
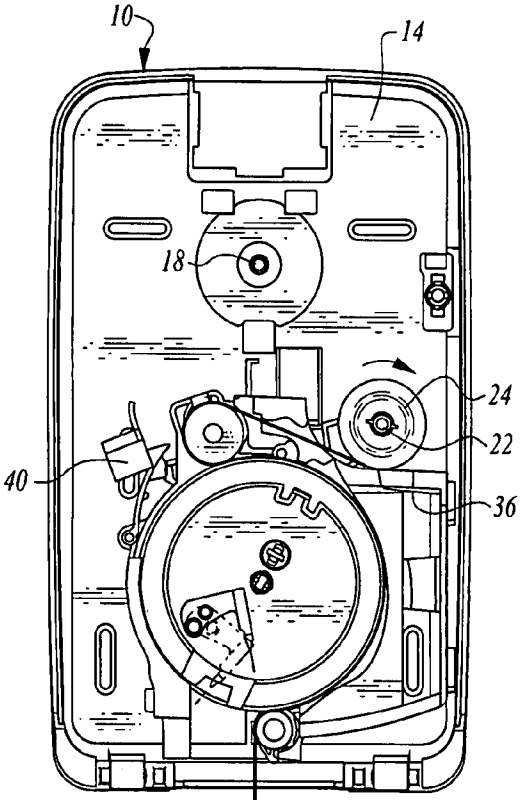
FIG. 9 is an elevational view illustrating the interior of the dispensing cabinet and illustrating the positioning and movement of paper sheet material during dispensing from the stub roll by dispensing mechanism of the apparatus.
Figure 13:
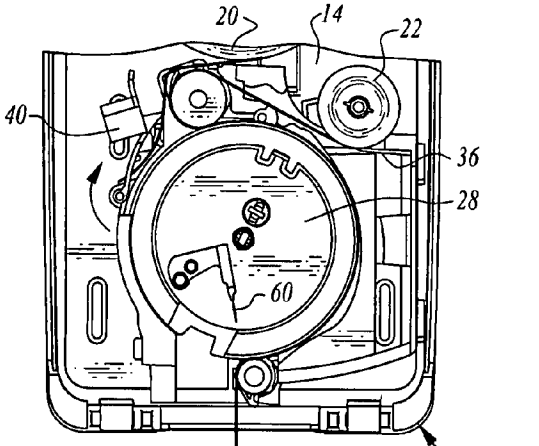

Located below the spindle 22 is a stub roll support 36 engaged by the outer periphery of the stub roll and providing support for the stub roll and the spindle 22, the lever being freely pivotal. The stub roll holder or spindle 22 is biased in the direction of the stub roll support 36 and movable toward the stub roll support during dispensing of paper sheet material from the stub roll. FIGS. 9, 11 and 13 provide a good illustration of this condition.

Figure 4:
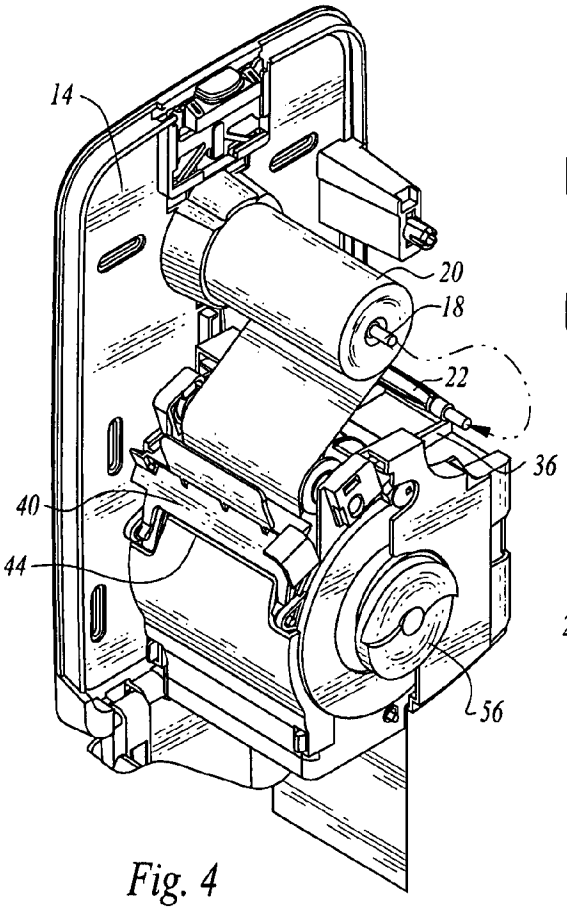
FIG. 4 is a perspective view similar to FIG. 3, but illustrating a primary roll having been changed into a stub roll due to prior dispensing of the sheet material of the primary roll, the stub roll preparatory to being placed on the stub roll holder or spindle as shown by the arrow headed dash line.

Stub rolls are of course formed from a full primary roll of toilet tissue after a certain amount of dispensing from the primary roll has taken place. FIG. 4 shows a substantially depleted primary roll 20, i.e. a stub roll, and FIG. 4 illustrates the process of removal of a formerly full roll 20 from spindle 18 to spindle 22 at a suitable stage of operation. The present invention discloses a unique approach for initiating dispensing from a full or primary roll responsive to the stub roll on spindle 22 being exhausted.

In the disclosed arrangement a pivotally mounted transfer door 40 is provided. Transfer door 40 has a proximal portion at the location of pivotal interconnection of the transfer door with other dispenser structure. The proximal portion includes two downwardly extending pivot arms 42 which define a transfer door opening 44. The transfer door also includes a distal portion 46 located adjacent to the outer surface of rotatable drum 28.

Figure 8:
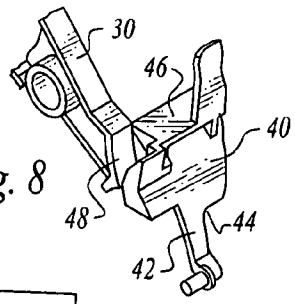
FIG. 8 is a greatly enlarged, perspective view showing cooperable portions of the lever and transfer door.

Lever 30 has an end 48 which is engageable with the transfer door to prevent movement of the distal portion thereof toward the rotatable drum. Engagement is accomplished when the stub roll is transferred to spindle 22. This remains the situation until the stub roll becomes exhausted, engagement by the stub roll with support 36 maintaining the lever in an orientation, as shown in FIG. 8, wherein the transfer door is prevented from falling under the influence of gravity toward the rotatable drum. This relationship between the transfer door and the lever will exist until little or no toilet tissue remains on the stub roll, at which point the lever will disengage from the transfer door and allow pivoting of the transfer door and movement of the distal portion toward the rotatable drum to place a lead end portion of the primary roll into a position on the rotatable drum allowing dispensing of paper sheet material from the primary roll upon rotation of the rotatable drum.

Figure 16:
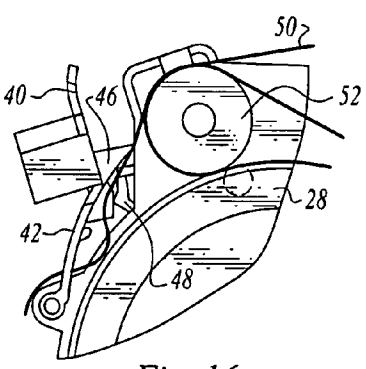

As can be seen in the drawings, at an earlier stage, immediately after a full primary roll 22 has been positioned on spindle 18, as shown in FIGS. 3 and 11, the lead end portion 50 of the primary roll 20 is manually passed through the transfer door opening 44. The transfer door may be readily pivoted outwardly to facilitate this operation. This is shown in FIGS. 13 and 16. At this stage the sheet material from the stub roll is still in position for dispensing, the stub roll sheet material looping over and back under a nip roller 52 forming a nip with the rotatable drum 28.

Figure 14:
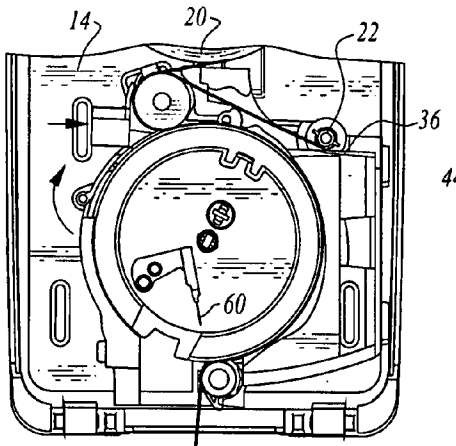
Figure 17:
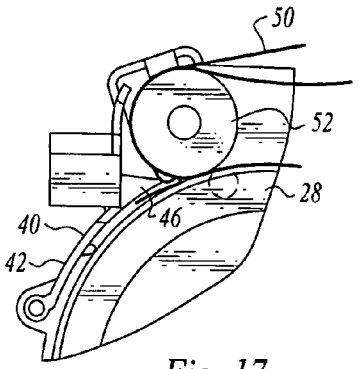

FIGS. 14 and 17 show the situation after the lever 30 disengages from the transfer door 40 and the transfer door 40 is allowed to fall forward toward the rotatable drum due to the fact that the stub roll no longer exists to provide support for the lever. In FIGS. 14 and 17 the distal portion of the transfer door has placed the lead end portion of the primary roll into a position on the rotatable drum allowing dispensing of the paper sheet material from the primary roll upon rotation of the rotatable drum.

In the arrangement illustrated, rotation of the rotatable drum 28 is caused by manual rotation of a knob 56 disposed externally of the cabinet and operatively connected to the drum.

Figure 15:
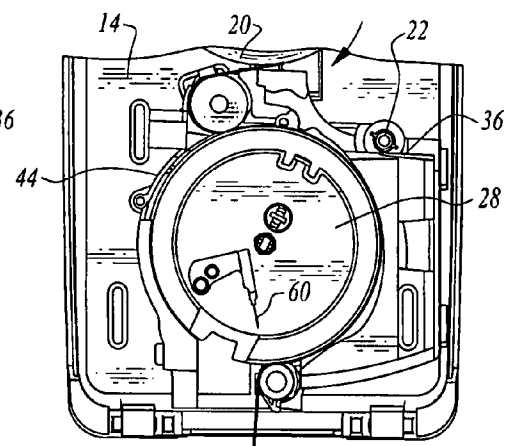
FIGS. 13, 14 and 15 are elevational views showing selected structural elements of the apparatus at sequential stages of the dispensing operation.
Figure 18:
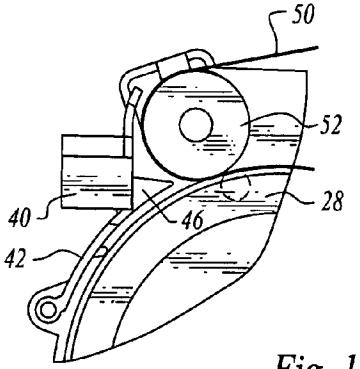
FIGS. 16, 17 and 18 are enlarged, sectional views showing the condition of the transfer door, rotatable drum and other components in the stages of operation corresponding to those shown in FIGS. 13, 14 and 15, respectively.

To avoid frictional drag, the transfer door does not actually ever touch the rotatable drum. After the stub roll is exhausted and the transfer door has closed pushing the primary roll paper sheet material towards the rotatable drum, rotation of the knob 56 will feed the primary roll sheet material through the dispensing mechanism and provide a primary roll tail extending from the bottom of the cabinet. This is shown in FIGS. 15 and 18.

At times, the primary paper sheet material may automatically load when the stub roll is nearly exhausted. When this happens, feed knob use will not be required for loading and two sheets will be dispensed, one from the primary roll and one from the stub roll, until the stub roll is completely exhausted.

In the arrangement illustrated, the dispensing apparatus includes a cutter blade 60 which is actuated upon rotation of the rotatable drum to sever the paper sheet material being dispensed. Such a cutting mechanism may be of any suitable type, and for that matter, the principles of the present invention can be applied to dispensers with a wide variety of cutting blade types including both movable and fixed.

The invention claimed is:

1. Dispensing apparatus for consecutively dispensing paper sheet material from a stub roll of said paper sheet material and a primary roll of said paper sheet material having a lead end portion, said apparatus comprising:

a dispensing cabinet defining an interior;

a primary roll holder within the dispensing cabinet interior for holding a primary roll of paper sheet material and allowing rotation thereof during dispensing of paper sheet material from said primary roll of paper sheet material;

a stub roll holder within the dispensing cabinet interior spaced from said primary roll holder for holding a stub roll of paper sheet material and allowing rotation thereof during dispensing of paper sheet material from said stub roll of paper sheet material;

a dispensing mechanism including a rotatable drum having an outer surface supporting paper sheet material from said stub roll during dispensing of paper sheet material from said stub roll;

a lever having first and second lever ends and pivotally mounted within said cabinet interior, said stub roll holder comprising a spindle attached to, supported by, and extending outwardly from the first lever end;

a stub roll support positioned below said spindle engaged by the outer periphery of a stub roll on said spindle and providing support for said stub roll, said stub roll holder and said first lever end, said stub roll holder biased in the direction of said stub roll support and movable toward said stub roll support during dispensing of paper sheet material from said stub roll; and a pivotally mounted transfer door having a proximal portion and a distal portion located within said cabinet interior adjacent to said rotatable drum and biased to move said distal portion toward said rotatable drum, the second lever end engageable with said transfer door to prevent movement of the distal portion toward the rotatable drum when the stub roll engages and is supported by said stub roll support, pivoting of said lever caused by exhaustion of the stub roll disengaging said second lever end from said transfer door and allowing pivoting of said transfer door and movement of the distal portion toward said rotatable drum to place the lead end portion of said primary roll into a position on said rotatable drum allowing dispensing of paper sheet material from said primary roll upon rotation of said rotatable drum.

2. The dispensing apparatus according to claim 1 wherein said transfer door defines a transfer door opening, the lead end portion of said primary roll extending through said transfer door opening prior to placement of the lead end portion of the primary roll into position on the rotatable drum.

3. The dispensing apparatus according to claim 2 including a primary roll lead end portion support structure in said cabinet interior for supporting the lead end portion of the primary roll when said lead end portion extends through said transfer door opening, said transfer door proximal portion pivotally attached adjacent to said transfer door opening.

4. The dispensing apparatus according to claim 3 wherein the width of said transfer door opening is at least the width of said lead end portion.

5. The dispensing apparatus according to claim 1 wherein said transfer door is biased to move said distal portion thereof toward the rotatable drum by gravity.

6. The dispensing apparatus according to claim 1 wherein said stub roll holder is biased in the direction of said stub roll support by gravity.

7. The dispensing apparatus according to claim 1 additionally comprising a nip roller adjacent to said rotatable drum and forming a nip with said rotatable drum, pivoting of said transfer door and movement of the distal portion thereof toward the rotatable drum placing the lead end portion of the primary roll at said nip.

8. The dispensing apparatus according to claim 7 additionally comprising an externally disposed manually operated feed knob for rotating said rotatable drum to effect passage of the lead end portion of said primary roll through said nip after pivoting of said transfer door and movement of the lead end portion to position on the rotatable drum.

9. A method for consecutively dispensing paper sheet material from a stub roll of paper sheet material and a primary roll of said paper sheet material having a lead end portion, said method including the steps of:

positioning a primary roll holder within a dispensing cabinet interior for holding a primary roll of paper sheet material and allowing rotation thereof during dispensing of paper sheet material from said primary roll of paper sheet material;

positioning a stub roll holder within the dispensing cabinet interior spaced from said primary roll holder for holding a stub roll of paper sheet material and allowing rotation thereof during dispensing of paper sheet material from said stub roll of paper sheet material;

supporting paper sheet material from said stub roll on the outer surface of a rotatable drum within the dispenser cabinet during dispensing of paper sheet material from said stub roll;

pivotally mounting a lever having first and second lever ends within said cabinet interior, said stub roll holder comprising a spindle attached to, supported by, and extending outwardly from the first lever end;

providing a stub roll support positioned below said spindle engaged by the outer periphery of a stub roll on said spindle and supporting said stub roll, said stub roll holder and said first lever end on said stub roll support;

biasing said stub roll holder in the direction of said stub roll support and moving said stub roll holder toward said stub roll support during dispensing of paper sheet material from said stub roll;

locating a pivotally mounted transfer door having a proximal portion and a distal portion within said cabinet interior adjacent to said rotatable drum and biasing said transfer door to move said distal portion toward said rotatable drum;

engaging the second lever end with said transfer door to prevent movement of the distal portion toward the rotatable drum; and pivoting said lever responsive to exhaustion of the stub roll to disengage said second lever end from said transfer door and allow pivoting of said transfer door and movement of the distal portion toward said rotatable drum to place the lead end portion of said primary roll into a position on said rotatable drum allowing dispensing of paper sheet material from said primary roll upon rotation of said rotatable drum.

10. The method according to claim 9 wherein said transfer door defines a transfer door opening, the lead end portion of said primary roll extending through said transfer door opening prior to placement of the lead end portion of the primary roll into position on the rotatable drum.

11. The method according to claim 10 including the additional step of providing a primary roll lead end support structure in said cabinet interior for supporting the lead end portion of the primary roll when said lead end portion extends through said transfer door opening.

12. The method according to claim 11 wherein the width of said transfer door opening is at least the width of said lead end portion.

13. The method according to claim 9 wherein said transfer door is biased to move said distal portion thereof toward the rotatable drum by gravity.

14. The method according to claim 9 wherein said stub roll holder is biased in the direction of said stub roll support by gravity.

15. The method according to claim 9 additionally comprising positioning a nip roller adjacent to said rotatable drum and forming a nip with said rotatable drum, pivoting of said transfer door and movement of the distal portion thereof toward the rotatable drum placing the lead end portion of the primary roll at said nip.

16. The method according to claim 15 additionally comprising utilizing an externally disposed manually operated feed knob for rotating said rotatable drum to effect passage of the lead end portion of said primary roll through said nip after pivoting of said transfer door and movement of the lead end portion to position on the rotatable drum.

17. The method according to claim 9 wherein the transfer door distal portion is maintained spaced from the rotatable drum to avoid frictional drag being exerted on the paper sheet material.

* * * * *